US005695531A

United States Patent [19]

Makino et al.

[11] Patent Number: 5,695,531

[45] Date of Patent: Dec. 9, 1997

[54] FUEL TREATING DEVICE

[76] Inventors: Shinji Makino, c/o I.B.E. Co., Ltd. 18 Aza Gochu, Oaza Nishihazu, Hazu-cho, Hazu-gun, Aichi 444-07; Mitsuhiro Sakamoto, c/o Yagyu Kogyo Co., Ltd. 7-11, Uosakinakamachi 1-chome, Higashinada-ku, Kobe-shi, Hyogo 658, both of Japan

[21] Appl. No.: 556,975

[22] PCT Filed: Apr. 6, 1995

[86] PCT No.: PCT/JP95/00684

§ 371 Date: Dec. 6, 1995

§ 102(e) Date: Dec. 6, 1995

[87] PCT Pub. No.: WO95/27849

PCT Pub. Date: Oct. 19, 1995

[30] Foreign Application Priority Data

Apr. 6, 1994 [JP] Japan ..... 6-093665

[51] Int. Cl.[6] ..... C10L 5/00

[52] U.S. Cl. ..... 44/639; 44/530; 137/269; 137/274

[58] Field of Search ..... 44/639, 628, 929, 44/530; 137/269, 274

[56] References Cited

U.S. PATENT DOCUMENTS

| | | | |
|---|---|---|---|
| 2,955,028 | 10/1960 | Bevans | 44/639 |
| 3,789,096 | 1/1974 | Church et al. | 264/60 |
| 4,106,478 | 8/1978 | Higashijima | 126/263 |
| 4,205,957 | 6/1980 | Fujiwara . | |
| 4,404,152 | 9/1983 | Pollock | 264/15 |
| 4,407,967 | 10/1983 | Luks | 501/81 |
| 5,059,217 | 10/1991 | Arroyo et al. | 44/639 |
| 5,299,746 | 4/1994 | Thuenker et al. | 44/639 |

*Primary Examiner*—Margaret Medley

[57] ABSTRACT

The object of the present invention is to provide a fuel treating device having a small pressure loss and a high contacting efficiency between fuel and fuel treating material. To attain said object, fuel treating material(s) 16, 26, 36 is(are) movably arranged in a fuel treating container 12, 22, 32 and said fuel treating material(s) 16, 26, 36 is(are) moved by flow pressure of the fuel to improve the contacting efficiency between said fuel treating material(s) 16, 26, 36 and the fuel and treat fuel by contacting with said fuel treating materials 16, 26, 36.

11 Claims, 4 Drawing Sheets

FUEL TREATING DEVICE

FIELD OF THE INVENTION

The present invention relates to a device for treating fuel.

DESCRIPTION OF THE PRIOR ART

Hitherto, as shown in FIG. 7, a fuel treating device (1) wherein a pair of perforated plates (5, 6) are arranged in a container (2) having a fuel entrance (3) at one end and a fuel exit (4) at the other end and granular fuel treating materials (7) such as active carbon, zeolite, ceramics and the like charged between said pair of perforated plates (5, 6) has been provided to use for said fuel treatment. In said traditional fuel treating device (1), it is necessary to raise the charge density of said granular fuel treating materials (7) to increase the contacting effect between the fuel and said granular fuel treating materials (7) and in a case where the charge density of said granular fuel treating materials (7) is raised as above described, the pressure loss in said fuel treating device (1) may become so large that a high pressure is necessary to put the fuel into said fuel treating device (1).

Further, the effect of said traditional fuel treating materials such as active carbon, zeolite, ceramics and the like to treat the fuel may not be enough.

DISCLOSURE OF THE INVENTION

As a means to solve the above described problems of said traditional fuel treating device, the present invention provides a fuel treating device (11, 21, 31) consisting of a fuel treating container (12, 22, 32) having a fuel entrance (14, 24, 34) and a fuel exit (15, 25, 35) and fuel treating material(s) (16, 26, 36) arranged movably by fuel flow in said fuel treating container (12, 22, 32).

The fuel in the present invention is such as light oil, gasoline, kerosene and the like, and as the arrangement of said fuel treating materials (16, 26, 36) in said fuel treating container (12, 22, 32), it is preferable that said fuel treating material (16) is molded into grain shape and a plural number of the resulting grain-shaped fuel treating materials (16) are separately arranged in said fuel treating container (12), or a plural number of perforated small containers (27) in which said grain-shaped fuel treating materials (26) are movably packed by said fuel flow are arranged in said fuel treating container (22), or said fuel treating material (36) is molded into propeller shape and one or more of the resulting propeller-shaped fuel treating material(s) (36) is(are) arranged in a fuel treating container (32) toward the upper stream of the fuel flow.

As said fuel treating material (16, 26, 36), ceramic block is a preferable material, prepared by dipping a ceramics in an aqueous solution of crystal produced by dissolving ferric chloride in a large amount of aqueous solution of sodium hydroxide, neutralizing said an aqueous solution by aqueous solution of hydrochloric acid, and concentrating said neutralized an aqueous solution, or dissolving ferrous sulfate in a large amount of an aqueous solution of hydrochloric acid and concentrating said solution, or contacting a ceramics with the air passed through said aqueous solution of said crystal.

In said fuel treating device (11, 21, 31), a fuel is put into said fuel treating container (12, 22, 32) through said fuel entrance (14, 24, 34). Said fuel is treated by contacting said fuel treating material (16, 26, 36). Said fuel treating material (16, 26, 36) may be moved by flow pressure of said fuel in said fuel treating container (12, 22, 32) when said fuel contacts said fuel treating material (16, 26, 36) and said fuel may be agitated by said movement of said fuel treating material (16, 26, 36) and as a result, the contacting efficiency between said fuel treating material (16, 26, 36) and said fuel may be much improved.

In this case, when a plural number of said grain-shaped fuel treating materials (16) are separately arranged in said fuel treating container (12), said grain-shaped fuel treating materials (16) may roll and move in said fuel treating container (12) by the flow pressure of said fuel and said fuel may be agitated by said rolling or moving of said grain-shaped fuel treating materials (16) and as a result, the contacting efficiency between said fuel treating materials (16) and said fuel may be much improved.

Further, when a plural number of said perforated small containers (27) in which said grain-shaped fuel treating materials (26) are movably packed are arranged in said fuel treating container (22), said grain-shaped fuel treating material (26) may be moved by the flow pressure of said fuel in said perforated small container (27) and said fuel may be agitated by said moving of said fuel treating material (26) and as a result, the contacting efficiency between said fuel treating material (26) and said fuel may be much improved.

Still further, when said fuel treating material (36) is molded into a propeller shape and arranged in said fuel treating container (32) toward the upper stream of the fuel flow, said propeller-shaped fuel treating material(s) (36) may be rotated by the flow pressure of said fuel in said fuel treating container (32) and said fuel may be agitated by said rotating of propeller-shaped fuel treating material(s) (36) and as a result, the contacting efficiency between said fuel treating material (36) and said fuel may be much improved.

In a case where a ceramic block is used as a fuel treating material (16, 26, 36), the molecular or cluster weight of the fuel may be reduced by far infrared radiation from said ceramic block to improve the qualities of said fuel.

To activate the above described effect of said ceramic block, it is desirable to treat the fuel as follows:

When ferric chloride is dissolved in a large amount of aqueous solution of sodium hydroxide, it seems that iron in said ferric chloride is activated. When the aqueous solution containing said activated iron is neutralized, crystals of chloride of said activated iron are obtained. Further, when ferrous sulfate is dissolved in a large amount of aqueous solution of hydrochloric acid, it seems that iron in said ferrous sulfate is activated . When the aqueous solution containing said activated iron is concentrated, crystal of chloride of said activated iron are obtained. The resulting crystal prepared by above described two methods is preferably purified by dissolving said crystal in a mixture of iso-propanol and water and concentrating said solution to recrystallize.

When said crystals are dissolved in water, said aqueous solution may contain a chloride of said activated iron and the effects of said ceramic block may be amplified by dipping said ceramic block in said aqueous solution or contacting the air passed through said aqueous solution.

Ceramics used in the present invention may be well-known ceramics such as silicon oxide, aluminium oxide, zirconium oxide, titanium oxide, silicon nitride, boron nitride, silicon carbide and the like and two or more kinds of said ceramics may be mixed. A desirable mix consists of silicon oxide and aluminium oxide.

BRIEF DESCRIPTION OF THE DRAWINGS

FIG. 1 is a side sectional view.

FIG. 2 is a cross sectional view.

FIG. 3 is a side sectional view.

FIG. 4 is a perspective view of the perforated small container which is opened.

FIG. 5 is a side sectional view.

FIG. 6 is a sectional view along the line 6—6 in FIG. 5.

DETAIL DESCRIPTION OF THE INVENTION

Figure 1:
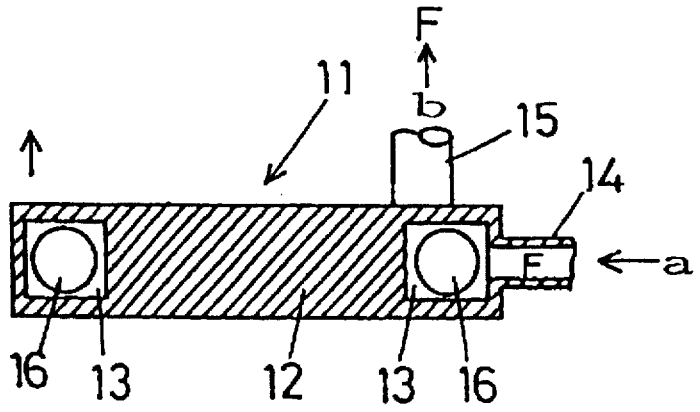
FIG. 1 and FIG. 2 relate to the first embodiment of the present invention.
Figure 2:
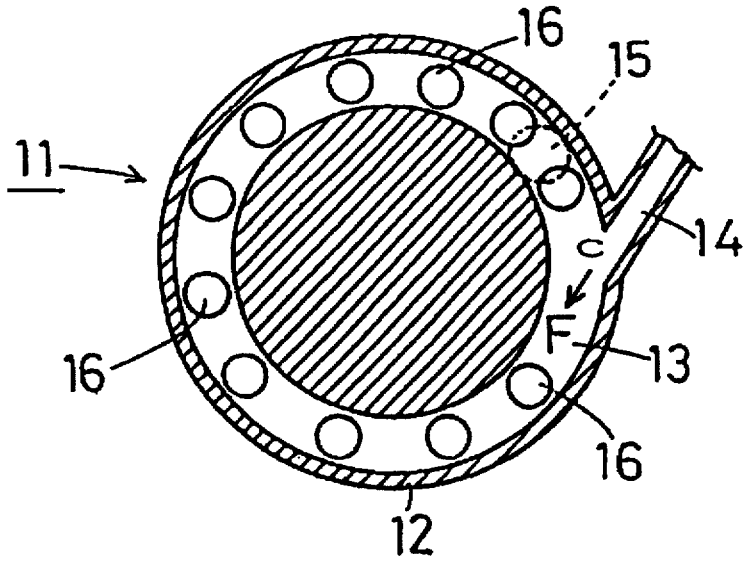

FIG. 1 and FIG. 2 relate to the first embodiment of the present invention. A fuel treating device (11) shown in FIG. 1 and FIG. 2 comprises a fuel treating container (12) having a disk shape, a flow path (13) formed on the circumference of said fuel treating container (12), a fuel entrance (14) connecting diagonally to said flow path (13), a fuel exit (15) extended upward from said flow path (13) and a plural number of grain-shaped ceramics (16) arranged separately in said flow path (13).

Commonly, said grain-shaped ceramics (16) have a diameter in the range between 3 to 10 mm and preferably 5 to 7 mm.

When the fuel F is put into said flow path (13) of said fuel treating device (11) from said fuel entrance (14) as shown by an arrow a in FIG. 1, said fuel F is forced in a direction shown by an arrow C in FIG. 2 to flow in said flow path (13) and discharged from said fuel exit (15) as shown by an arrow b in FIG. 1. While said fuel F flows in said flow path (13), said fuel F contacts with said grain-shaped ceramics (16) and said grain-shaped ceramics (16) are rolled and moved by the flow pressure of said fuel F.

Said fuel F is agitated by said moving grain-shaped ceramics (16) and contacted effectively with said grain-shaped ceramics (16) and decomposed to an activated fuel having a low molecular weight by the energy from said grain-shaped ceramics (16). The resulting activated fuel having a low molecular weight has a high efficiency of combustion and little amount of C and CO are produced in combustion of said activated fuel.

Figure 3:
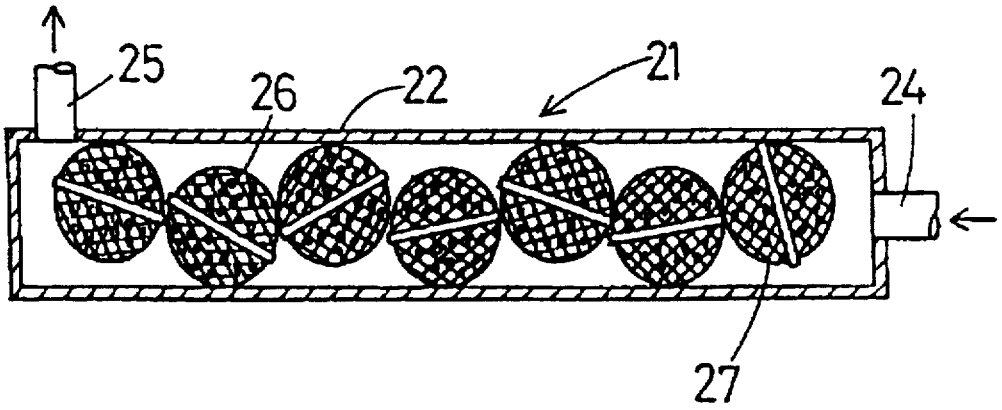
FIG. 3 and FIG. 4 relate to the second embodiment of the present invention.
Figure 4:
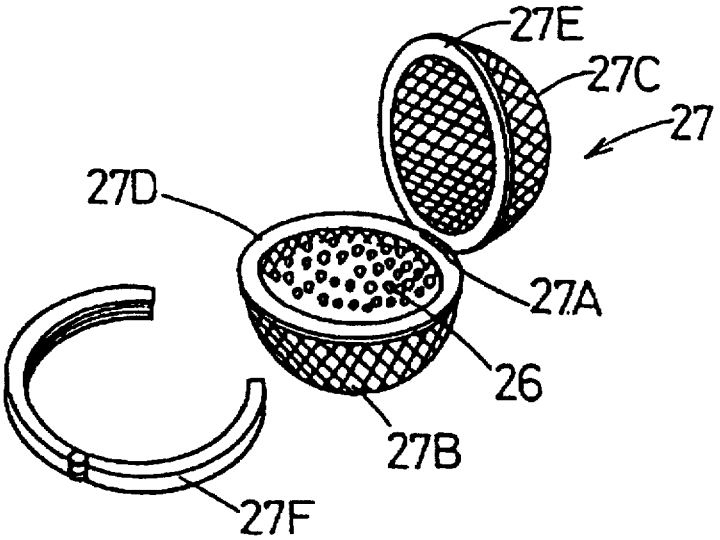

FIG. 3 and FIG. 4 relate to the second embodiment of the present invention. A fuel treating device (21) of this embodiment comprises a cylindrical fuel treating container (22) having a fuel entrance (24) at one end and a fuel exit (25) at the other end, a plural number of perforated small containers (27) arranged in said fuel treating container (22) and grain-shaped ceramics (26) packed in each perforated small container (27) wherein said perforated small container (27) has a spherical shape and consists of a pair of hemispherical cages (27B, 27C) connected by a hinge (27A) respectively and said hemispherical cages (27B, 27C) are closed by putting the circumference flanges (27D, 27E) of said hemispherical cages (27B, 27C) together and fixed by a lock band (27F).

Commonly, said grain-shaped ceramics (26) have a diameter in the range between 3 to 10 mm, preferably 5 to 7 mm and assuming the highest packing density of said grain-shaped ceramics (26) is 100%. Commonly, said grain-shaped ceramics (26) are packed in said perforated small container (27) at a packing density in the range between 60 to 70% so that said grain-shaped ceramics (26) can move in said perforated small container (27).

When the fuel F is put into said fuel treating container (22) through said fuel entrance (24), the flow of said fuel F is disturbed by contacting with said perforated small container and at the same time said fuel F passes through said perforated small container (27) to be treated by contacting with said grain-shaped ceramics (26) as a fuel treating material. When said fuel F passes through said perforated small container (27), said grain-shaped ceramics (26) is moved since said grain-shaped ceramics (26) are scatteringly packed in said perforated small container (27) and said fuel F is agitated by said moving grain-shaped ceramics (26) to improve the efficiency of contact between said fuel F and said grain-shaped ceramics (26).

Figure 5:
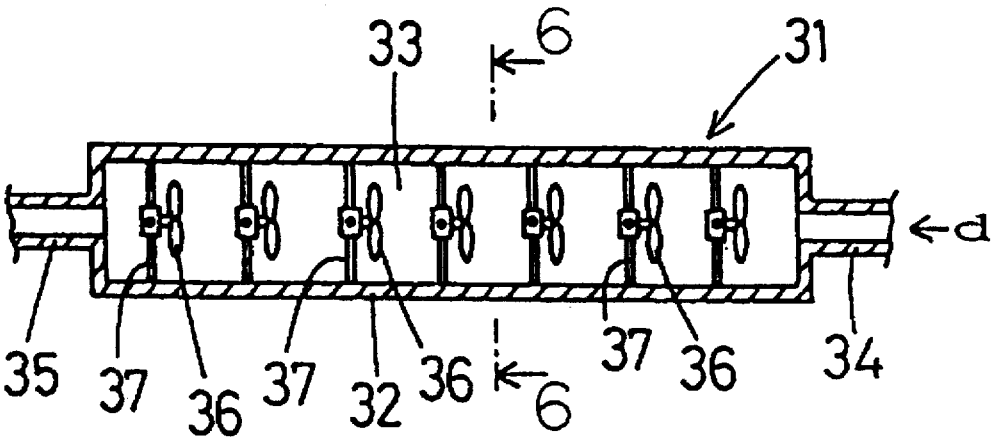
FIG. 5 and FIG. 6 relate to the third embodiment of the present invention.
Figure 6:
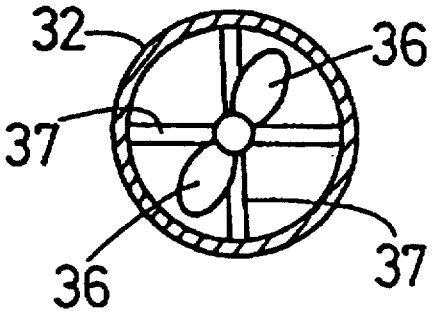

FIG. 5 and FIG. 6 relate to the third embodiment of the present invention. A fuel treating device (31) of this embodiment comprises a cylindrical fuel treating container (32) in which a flow path (33) is formed, a fuel entrance (34) connecting to one end of said fuel treating container (32) and a fuel exit (35) connecting to the other end of said fuel treating container (32) and a plural number of propeller-shaped ceramics (36) supported rotatably by frames (37) in said fuel treating container (32) wherein each of the propeller-shaped ceramics (36) is arranged toward the upper stream of the fuel flow.

The number of said propeller-shaped ceramics (36) arranged in said fuel treating container (32) may not be limited in the present invention but it is preferable to arrange said propeller-shaped ceramics (36) as close as possible together so that the flow resistance of said propeller-shaped ceramics (36) does not become excessive. Further, it is preferable to settle the diameter of said propeller-shaped ceramics (36) smaller than the inside diameter of said fuel treating container (32). Still further, in this embodiment, said propeller-shaped ceramics (36) have two wings or blades but a propeller-shaped ceramics having three blades, a propeller-shaped ceramics having four blades, and a propeller-shaped ceramics having more than four blades may be used in the present invention.

When the fuel F is put into said flow path (33) of said fuel treating device (31) as shown by an arrow d in FIG. 5, said propeller-shaped ceramics (36) are rotated by the flow pressure of said fuel F and said fuel F is agitated by said rotating propeller-shaped ceramics (36) to contact said fuel F effectively with said propeller-shaped ceramics (36) to produce an activated fuel having a low molecular weight. The resulting activated fuel is discharged from said fuel exit (35).

Figure 7:
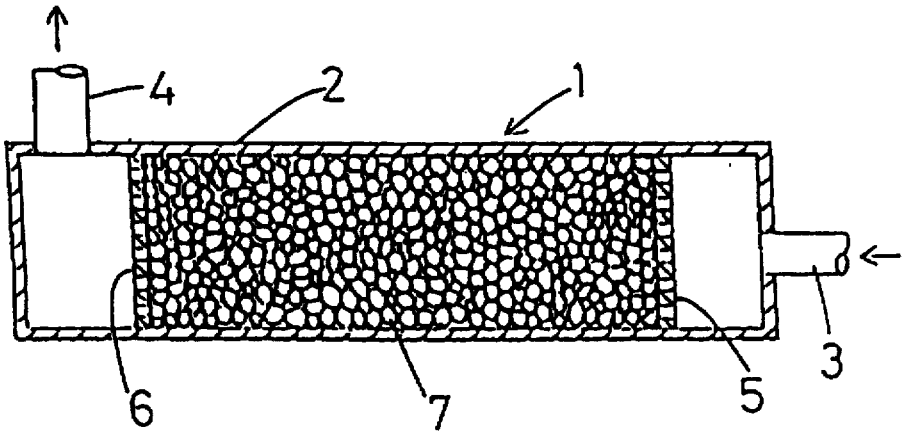
Fig. 7 PRIOR ART
FIG. 7 is a side sectional view of a traditional fuel treating device.

Automotive fuel was treated by said fuel treating devices (11, 21, 31) and said traditional fuel treating device (1) shown in FIG. 7 as a comparison and practical driving test using an automobile on the market was carried out by using said treated fuel. In this test fuel treating materials (16, 26, 36) A, A2, B, B2, C, C2, D, D2, E, E2 and F, F2 used in said fuel treating device 11, 21, 31) and a fuel treating material (7) G were respectively prepared as follows:

PREPARATION OF ACTIVE FERRIC CHLORIDE CRYSTAL FOR TREATMENT OF FUEL TREATING MATERIALS A, A2, C, C2, E AND E2

1 g of ferric chloride anhydride was desolved in 5 ml. of 12N aqueous solution of sodium hydroxide with agitation and said solution was kept for more than 5 hours at room temperature. Said solution was nuetralized by 12N aqueous solution of hydrochloric acid at a pH about 7 and said neutralized solution was filtered through a filter paper (No. 5C) and then said filtered solution was concentrated to deposit a crystal.

The resulting crystal was collected and dried in a desiccator and then said dried crystal was dissolved in 10 ml of a mixture of iso-propanol and water (80:20 weight ratio). Said solution was filtered by filter paper (No. 5C) and after that concentrated to remove solvents to dry. That extraction-concentration-drying operation was repeated a few times to obtain a purified crystal of activated ferric chloride.

Said crystal was dissolved in distilled water to prepare 2 ppm aqueous solution of said activated ferric chloride.

PREPARATION OF THE FUEL TREATING MATERIALS A, A2, C, C2, E AND E2

The fuel treating materials A and A2:

Polyvinylalcohol and water were added in a mixture of silicon oxide and aluminium oxide (1:1 weight ratio) to mix and said mixture was molded to a spherical grain shape having a diameter of 6 mm and then said grain was burned at 1000° C. for 3 hours to obtain spherical grain-shaped ceramics used for the fuel treating materials A and A2.

The fuel treating materials C and C2:

Polyvinylalcohol and water were added in a mixture of zirconium oxide and titanium oxide (1:1 weight ratio) to mix and said mixture was molded to a spherical grain shape having a diameter of 6 mm and then said grain was burned at 1000° C. for 3 hours to obtain spherical grain-shaped ceramics used for the fuel treating materials C and C2.

The fuel treating materials E and E2:

Polyvinylalcohol and water were added in a mixture of silicon nitride and boron nitride (1:1 weight ratio) and said mixture was molded to a propeller shape as shown in the third embodiment and then said propeller-shaped mixture was burned at 1000° C. for 3 hours to obtain propeller-shaped ceramics used for the fuel treating meterials E and E2.

Said resulting fuel treating materials A, C and E were dipped in said aqueous solution of said activated ferric chloride and kept for 2 hours and after that said fuel treating materials A, C and E were collected and vacuum-dried to obtain activated fuel treating materials.

Further, the resulting fuel treating materials A2, C2 and E2 were respectively contacted with the air passed through said aqueous solution of said activated ferric chloride at a flow rate 5 l/min for 3 hours to obtain activated fuel treating materials.

PREPARATION OF ACTIVE FERRIC CHLORIDE CRYSTAL FOR TREATMENT OF THE FUEL TREATING MATERIALS B, B2, D, D2, F AND F2

1 g of ferrous sulfate was dissolved in 5 ml of 12N aqueous solution of hydrochloric acid with agitation and said solution was filtered through a filter paper (No. 5C) followed by concentration of said filtrated solution to deposit a crystal.

The resulting crystal was collected and vacuum-dried in a desiccator and said dried crystal was dissolved in 10 ml of a mixture of iso-propanol and water (80:20 weight ratio) and said solution was filtered through a filter paper (No. 5C) followed by concentration of said filtered solution to remove solvents to dry. That extraction-concentration-drying operation was repeated a few times to obtain a purified crystal of the activated ferric chloride.

Said crystal was dissolved in the distilled water to prepare 2 ppm aqueous solution of said activated ferric chloride.

PREPARATION OF THE FUEL TREATING MATERIALS B, B2, D, D2, F AND F2

The fuel treating materials B and B2:

Polyvinylalcohol and water were added in a mixture of silicon oxide and aluminium oxide (1:1 weight ratio) to mix and said mixture was molded to a spherical grain shape having a diameter 6 mm and then said grain was burned at 1000° C. for 3 hours to obtain spherical grain-shaped ceramics used for the fuel treating materials B and B2.

The fuel treating materials D and D2:

Polyvinylalcohol and water were added in a mixture of zirconium oxide and titanium oxide (1:1 weight ratio) to mix and said mixture was molded to a spherical grain shape having a diameter 6 mm and then said grain was burned at 1000° C. for 3 hours to obtain spherical grain-shaped ceramics used for the fuel treating materials D and D2.

The fuel treating materials F and F2:

Polyvinylalcohol and water were added in a mixture of silicon nitride and boron nitride (1:1 weight ratio) and said mixture was molded to a propeller shape as shown in the third embodiment and then said propeller-shaped mixture was burned at 1000° C. for 3 hours to obtain propeller-shaped ceramics used for the fuel treating meterials F and F2.

Said resulting fuel treating materials B, D and F were dipped in said aqueous solution of said activated ferric chloride and kept for 2 hours and after that said fuel treating materials B, D and F were collected and vacuum-dried to obtain activated fuel treating materials.

Further, the resulting fuel treating materials B2, D2 and F2 were respectively contacted with the air passed through said aqueous solution of said activated ferric chloride at a flow rate 5 l/min for 3 hours to obtain activated fuel treating materials.

PREPARATION OF THE FUEL TREATING MATERIAL G

Polyvinylalcohol and water were added in a mixture of silicon oxide and aluminium oxide (1:1 weight ratio) to mix and said mixture was molded to a spherical grain shape having a diameter 6 mm and then said grain was burned at 1000° C. for 3 hours to obtain spherical grain-shaped ceramics used for the fuel treating material G.

Each fuel treating material A, A2, B and B2 was arranged separately in said fuel treating container (12) of the first embodiment as shown in FIG. 1 and FIG. 2 and each fuel treating material C, C2, D and D2 was packed in said perforated small container (27) of the second embodiment in a packing density 80% as shown in FIG. 3 and FIG. 4 and then a plural number of said perforated small containers (27) were arranged in said fuel treating container (22) and each fuel treating material E, E2, F and F2 was arranged in said fuel treating container (32) of the third embodiment as shown in FIG. 5 and FIG. 6.

Further, as Comparison 1, said fuel treating materials G were tightly charged in said traditional fuel treating container (2) as shown in FIG. 7 and as Comparison 2, said fuel treating materials A treated by said aqueous solution of active ferric chloride were tightly charged in said traditional fuel treating container (2) as shown in FIG. 7.

Practical driving test was carried out using above-described 14 kinds of fuel treating devices and using an automobile with an engine having a cylinder volume of 2800 cc. Fuel consumption when said automobile runs on a flat ground at a speed 60 km/h for 5 km was determined. In this test, 4 steps of average load, 20 kg, 30 kg, 40 kg and 50 kg were applied. The relationship between average load and fuel consumption amount is shown in Table 1.

TABLE 1

Effect of fuel treating materials of the present invention on fuel consumption amoun tof automobile

| | EXAMPLE 1 | | EXAMPLE 2 | | EXAMPLE 3 | | COMPARISON 1 |
|---|---|---|---|---|---|---|---|
| FUEL TREATING MATERIAL | A | B | C | D | E | F | G |
| 20 Kg*1 | 8.24 | 8.32 | 8.11 | 8.27 | 8.15 | 8.33 | 5.06 |
| 30 Kg*2 | 7.68 | 7.72 | 7.73 | 7.72 | 7.64 | 7.62 | 4.71 |
| 40 Kg*3 | 6.77 | 6.81 | 6.79 | 6.85 | 6.78 | 6.84 | 3.26 |
| 50 Kg*4 | 5.67 | 5.69 | 5.64 | 5.59 | 5.70 | 5.61 | — |

| | EXAMPLE 1 | | EXAMPLE 2 | | EXAMPLE 3 | | COMPARISON 2 |
|---|---|---|---|---|---|---|---|
| FUEL | A2 | B2 | C2 | D2 | E2 | F2 | A |
| 20 Kg*1 | 8.11 | 8.23 | 8.15 | 8.22 | 8.20 | 8.10 | 6.65 |
| 30 Kg*2 | 7.69 | 7.70 | 7.72 | 7.75 | 7.60 | 7.70 | 5.80 |
| 40 Kg*3 | 6.87 | 6.83 | 6.76 | 6.82 | 6.73 | 6.69 | 4.79 |
| 50 Kg*4 | 5.56 | 5.72 | 5.70 | 5.52 | 5.76 | 5.71 | 3.56 |

*1~*4: average load

—: can not be determined

Referring to Table 1, it may be clear that fuel efficiency is remarkably improved by using each fuel treating device (11, 21, 31) of the present invention comparing with the Comparison 1 using the traditional fuel treating device (1) in which the traditional fuel treating materials G are tightly packed.

Further, Comparison 2 using the traditional fuel treating device (1) in which the fuel treating materials treated with said aqueous solution of active ferric chloride shows improved fuel efficiency but said fuel efficiency is lower than each Example of the present invention.

Accordingly, in the present invention a fuel treating device having a small pressure loss and a high contact efficiency between fuel and fuel treating material and therefore, a high efficiency of improvement of fuel is provided.

We claim:

1. A fuel treating device comprising a fuel treating container having a fuel entrance and a fuel exit and a fuel treating material arranged movably by fuel flow in said fuel treating container wherein said fuel treating material is shaped as grains having a diameter within the range of 3 to 10 mm and wherein plural numbers of said grains are separately enclosed in at least one perforated container in said fuel treating container.

2. A fuel treating device in accordance with claim 1 wherein said grain-shaped fuel treating material is packed movably by fuel flow in a plural number of perforated small containers and said perforated small containers are arranged in said fuel treating container.

3. A fuel treating device in accordance with claim 1 wherein said grain-shaped material is prepared by dipping in an aqueous solution of a crystal prepared by dissolving ferric chloride in a large amount of aqueous solution of sodium hydroxide, neutralizing said solution with hydrochloric acid and concentrating said neutralized solution.

4. A fuel treating device in accordance with claim 1 wherein said grain-shaped material is prepared by contacting air passed through an aqueous solution of a crystal prepared by dissolving ferric chloride in a large amount of aqueous solution of sodium hydroxide, neutralizing said solution with hydrochloric acid and concentrating said neutralized solution.

5. A fuel treating device in accordance with claim 1 wherein said grain-shaped material is prepared by dipping in an aqueous solution of a crystal prepared by dissolving ferrous sulfate in a large amount of aqueous solution of hydrochloric acid and concentrating said solution.

6. A fuel treating device in accordance with claim 1 wherein said grain-shaped material is prepared by contacting air passed through an aqueous solution of a crystal prepared by dissolving ferrous sulfate in a large amount of aqueous solution of hydrochloric acid and concentrating said solution.

7. A fuel treating device comprising a fuel treating container having a fuel entrance and a fuel exit and a fuel treating material arranged movably by fuel flow in said fuel treating container wherein said fuel treating material is propeller shaped and said propeller-shaped fuel treating material is rotatably arranged toward the upper stream of fuel flow.

8. A fuel treating device in accordance with claim 7 wherein said propeller-shaped material is prepared by dipping in an aqueous solution of a crystal prepared by dissolving ferric chloride in a large amount of aqueous solution of sodium hydroxide, neutralizing said solution with hydrochloric acid and concentrating said neutralized solution.

9. A fuel treating device in accordance with claim 7 wherein said propeller-shaped material is prepared by contacting air passed through an aqueous solution of a crystal prepared by dissolving ferric chloride in a large amount of aqueous solution of sodium hydroxide, neutralizing said solution with hydrochloric acid and concentrating said neutralized solution.

10. A fuel treating device in accordance with claim 7 wherein said propeller-shaped material is prepared by dipping in an aqueous solution of a crystal prepared by dissolving ferrous sulfate in a large amount of aqueous solution of hydrochloric acid and concentrating said solution.

11. A fuel treating device in accordance with claim 7 wherein said propeller-shaped material is prepared by contacting air passed through an aqueous solution of a crystal prepared by dissolving ferrous sulfate in a large amount of aqueous solution of hydrochloric acid and concentrating said solution.

* * * * *